US007823825B2

(12) United States Patent
Genta et al.

(10) Patent No.: US 7,823,825 B2
(45) Date of Patent: Nov. 2, 2010

(54) ROLL MEDIUM SUPPORTING APPARATUS AND PRINTING APPARATUS

(75) Inventors: Shin Genta, Yokohama (JP); Kiyoto Komuro, Okaya (JP); Munetoyo Aono, Matsumoto (JP); Kazuma Ozaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 27 days.

(21) Appl. No.: 12/360,447

(22) Filed: Jan. 27, 2009

(65) Prior Publication Data

US 2009/0194631 A1 Aug. 6, 2009

(30) Foreign Application Priority Data

Jan. 28, 2008 (JP) ..... 2008-015891

(51) Int. Cl.
*B65H 75/24* (2006.01)

(52) U.S. Cl. ..... 242/573; 242/573.4

(58) Field of Classification Search ... 242/571.3–571.6, 242/571.8, 573, 573.4; 400/613
See application file for complete search history.

(56) References Cited

U.S. PATENT DOCUMENTS 3,001,736 A * 9/1961 Schultz et al. ..... 242/571.6
3,532,286 A * 10/1970 Mallette ..... 242/573.3
3,542,305 A * 11/1970 Feierabend ..... 242/573.3
3,817,469 A * 6/1974 Mosciatti et al. ..... 242/571.3
4,066,270 A * 1/1978 Elkin ..... 279/2.13
4,149,682 A * 4/1979 Gustafson et al. ..... 242/571.3
6,206,323 B1 * 3/2001 Byars ..... 242/577

FOREIGN PATENT DOCUMENTS

| | | |
|---|---|---|
| JP | 2003-276911 | 10/2003 |
| JP | 2007-261084 | 10/2007 |
| JP | 2007-261754 | 10/2007 |
| JP | 2007-290864 | 11/2007 |
| JP | 2007-290865 | 11/2007 |

* cited by examiner

*Primary Examiner*—Sang Kim
(74) *Attorney, Agent, or Firm*—Workman Nydegger

(57) ABSTRACT

A roll medium supporting apparatus includes: a base body portion to be inserted into a hollow shaft portion of a rolled medium; a plurality of contact supporting portions provided circumferentially of the base body portion so as to be capable of being displaced radially of the hollow shaft portion, having a plurality of predetermined positions within the displaceable range, and coming into contact with the inner peripheral surface of the hollow shaft portion and supporting the same; and a stabilizing mechanism configured to stabilize the contact supporting portions at the plurality of predetermined positions.

4 Claims, 12 Drawing Sheets

ROLL MEDIUM SUPPORTING APPARATUS AND PRINTING APPARATUS

BACKGROUND

1. Technical Field

The present invention relates to a roll medium supporting apparatus including a base body portion to be inserted into a hollow shaft portion of a rolled medium, and a plurality of contact supporting portions being provided circumferentially of the base body portion so as to be displaceable radially of the hollow shaft portion, having a plurality of predetermined positions within the displaceable range, and coming into contact with the inner peripheral surface of the hollow shaft portion and supporting the same, and a printing apparatus having the roll medium supporting apparatus.

In this application, the printing apparatus includes various types such as ink jet printers, wire dot printers, laser printers, line printers, copying machines, and facsimile machines.

2. Description of the Related Art

In the related art, a roll paper holder as a roll medium supporting apparatus provided in a printing apparatus includes a boss member as a base body portion and an impeller member as a contact supporting portion as shown in JP-A-2007-290864 and JP-A-2007-290865. The impeller member is provided so as to be capable of coming into contact with the inner peripheral surface of a hollow shaft of a roll paper shaft. The impeller member is provided so as to be displaceable radially of a roll paper shaft portion with respect to the boss member by rotating a cam lever member.

Therefore, when setting roll paper shafts having different diameters, they are accommodated only by rotating the cam lever member. In other words, it is adapted to change the diameter of the roll paper holder by displacing the impeller member without using an adapter for changing the diameter of the roll paper holder.

For example, setting a roll paper shaft having a diameter of 2 inches is enabled by rotating the cam lever member in one direction after having displaced, that is, after having closed the impeller member radially inwardly.

On the other hand, setting a roll paper shaft having a diameter of 3 inches is enabled by rotating the cam lever member in the opposite direction after having displaced, that is, after having opened the impeller member radially outwardly.

However, when the cam lever member is ill-positioned, the impeller member is also ill-positioned. When the roll paper shaft of 3 inches is set in a state in which the impeller member is half-way opened, it may cause slippage between the roll paper holder and the roll paper shaft of 3 inches, whereby paper may be sagged. In such a case, a sag of the paper might not be controlled.

When an attempt is made to set the roll paper shaft of 2 inches in a state in which the impeller member is half-way closed, the impeller member might be caught on the roll paper shaft, whereby setting might not be achieved.

SUMMARY

An advantage of some aspects of the invention is to provide a roll medium supporting apparatus which is adapted to allow easy setting of rolled medium having different sizes and to prevent occurrence of slippage between the rolled medium and the roll medium supporting apparatus in a set state, and a printing apparatus having the roll medium supporting apparatus.

According to a first aspect of the invention, a roll medium supporting apparatus includes a base body portion to be inserted into a hollow shaft portion of a rolled medium; a plurality of contact supporting portions provided circumferentially of the base body portion so as to be capable of being displaced radially of the hollow shaft portion, having a plurality of predetermined positions within the displaceable range, and coming into contact with the inner peripheral surface of the hollow shaft portion and supporting the same; and a stabilizing mechanism configured to stabilize the contact supporting portions at the plurality of predetermined positions.

In this configuration, the roll medium supporting apparatus includes the stabilizing mechanism configured to stabilize the contact supporting portions at the plurality of predetermined positions. Therefore, there is no risk of ill-positioning of the contact supporting portions other than the predetermined positions.

More specifically, the contact supporting portions are prevented from changing in such direction that the diameter formed by the contact supporting portions is reduced to a diameter smaller than the diameter formed by the inner peripheral surface of the hollow shaft portion.

Consequently, after having set the rolled medium in the roll medium supporting apparatus, occurrence of slippage between the contact supporting portions and the inner peripheral surface of the hollow shaft portion is prevented. Therefore, control of the sag of the roll medium is achieved.

Also, the contact supporting portions are prevented from changing in such direction that the diameter formed by the contact supporting portions is increased to a diameter larger than the diameter formed by the inner peripheral surface of the hollow shaft portion.

Consequently, when setting the rolled medium in the roll medium supporting apparatus, the contact supporting portions have no risk of being caught on the hollow shaft portion thereby disabling insertion of the base body portion.

Preferably, the stabilizing mechanism includes a lever member configured to displace the plurality of contact supporting portions in the radial direction, an urging unit configured to urge the lever member in one direction of the direction of rotation of the lever member, and an engaging portion being capable of engaging the lever member when the contact supporting portions are located at the predetermined positions.

In this configuration, the stabilizing mechanism includes the lever member configured to displace the plurality of contact supporting portions in the radial direction, the urging unit configured to urge the lever member in the one direction of the direction of rotation of the lever member, and the engaging portion being capable of engaging the lever member when the lever member is positioned at a position other than the downstream end in the urging direction of the urging unit within the rotatable range of the lever member and when the contact supporting portions are located at the predetermined positions. Therefore, the contact supporting portions may be positioned at the predetermined positions with high degree of accuracy.

For example, positioning of the contact supporting portions at the predetermined positions is ensured further reliably in comparison with the configuration of a torsion coil spring which urges the lever member in both directions of the direction of rotation of the lever member.

Preferably, the urging unit is configured to urge the lever member toward the position of the lever member assumed when the plurality of contact supporting portions are contracted in the radial direction.

In this configuration, the urging unit is configured to urge the lever member toward the position of the lever member assumed when the plurality of contact supporting portions are contracted in the radial direction.

Here, in a state in which the rolled medium is set in the roll medium supporting apparatus, the contact supporting portions come into contact with the inner peripheral surface of the hollow shaft portion, and hence a force is applied to the contact supporting portions radially inwardly.

Therefore, in this configuration, by engaging the lever member and the engaging portion when the contact supporting portions assume the predetermined positions being expanded to radially outermost positions, a radially inward force is opposed. In other words, the predetermined positions where the contact supporting portions assume the radially outermost positions can be fixed with higher degree of accuracy in comparison with the configuration in which the urging unit urges the lever member toward the position of the lever member assumed when the plurality of contact supporting portions are expanded to radially outermost positions.

Preferably, the contact supporting portions are configured to rotate integrally with the base body portion by a power of a motor.

In this configuration, the contact supporting portions are configured to rotate integrally with the base body portion by the power of the motor. Therefore, the slippage is effectively prevented when eliminating the sag of the medium by rotating the contact supporting portions in the normal direction and the reverse direction.

A printing apparatus according to a second aspect of the invention includes a feeding unit configured to feed printed medium, and a printing unit configured to execute a printing job by a printhead on the printed medium fed from the feeding unit, and the feeding unit includes the roll medium supporting apparatus according to the preferable modes of the invention described above.

In this configuration, the feeding unit includes the roll medium supporting apparatus according to the preferable modes of the invention described above.

Therefore, the printing apparatus achieves the same advantages as the preferable modes as described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
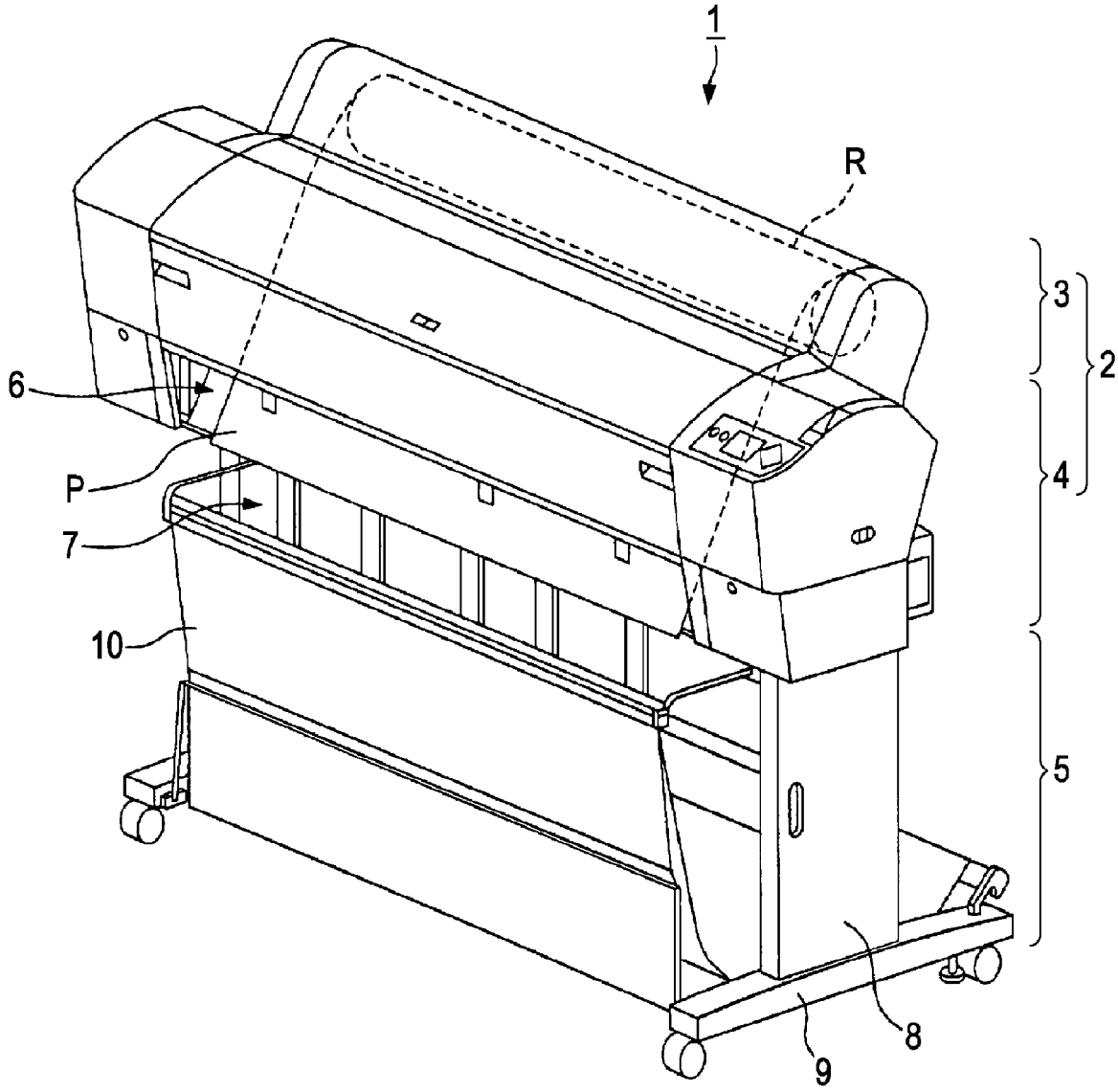
FIG. 1 is an appearance perspective view of a printer according to an embodiment of the invention.

Referring now to the drawings, an embodiment of the invention will be described.

FIG. 1 is an appearance perspective view of an ink jet printer (hereinafter, referred to as "printer") 1 as an example of a "printing apparatus" or a "liquid ejecting apparatus" in the invention.

In this specification, the term "liquid ejecting apparatus" is used as including not only ink jet-type printing apparatuses which execute a printing job onto a printed material by ejecting ink from a printhead as a liquid ejection head onto the printed material such as printing paper, printing apparatuses such as copying machines or facsimile machines, but also apparatuses which ejects liquid corresponding to a specific application instead of ink from the liquid ejecting head corresponding to the printhead onto an ejected material corresponding to the printed material to cause the liquid to be attached to the ejected material.

In addition, as the liquid ejecting head, a color material ejecting head used for manufacturing color filters such as liquid crystal displays or the like, an electrode material (conductive paste) ejecting head used for forming electrodes of organic EL displays or surface emission-type displays (FED) or the like, a biological organic substance ejecting head used for manufacturing biochips, and a sample ejecting head for ejecting samples as a precision pipette are exemplified in addition to the printhead described above.

The printer 1 is a large size printer which is able to print on ejected medium having a relatively large width or roll paper P as a printed medium of, for example, A0 size or B0 size in JIS standard, including a main body portion 2 having a roll paper supply unit 3 and a print executing unit 4 and a discharged paper receiving unit 5.

The main body portion 2 is provided on the top of supports 8 provided upright on a base 9, and includes a discharge port 6 for discharging the roll paper P after having printed obliquely downward. An opening 7 of a stacker 10 is positioned below the discharge port 6, and the roll paper P after having printed is discharged from the discharge port 6 toward the opening 7, and is received by the stacker 10.

The roll paper supply unit 3 is configured to accommodate a roll paper roll (hereinafter referred to as a "roll") R, and the roll paper P is delivered from the roll R, and is supplied obliquely downward to the print executing unit 4 for executing the printing job. The roll R is set in a roll paper holder 50 (see FIG. 2). When feeding the roll paper, the roll paper holder 50 is driven by a spindle motor 30 (see FIGS. 11A to 11E) as a roll drive unit, described later, to rotate, whereby the roll paper P is supplied to the downstream side.

The print executing unit 4 includes a printhead 17 (see FIGS. 11A to 11E) as a liquid ejecting unit or a printing unit for discharging (ejecting) ink as the liquid onto the roll paper P, a platen 28 (see FIGS. 11A to 11E) arranged so as to oppose the printhead 17, a transport drive roller (transport roller) 23 (see FIGS. 11A to 11E) provided on the upstream side of the printhead 17 for transporting the roll paper P to the downstream side and a transport driven roller 24 (see FIGS. 11A to 11E) being in press contact to the transport drive roller 23 and driven thereby, and a detection device (not shown) for detecting the phase of the transport drive roller 23 and the phase of the roll paper holder 50.

The printhead 17 is provided on a carriage 16 (see FIGS. 11A to 11E), and the carriage 16 moves in the primary scanning direction by receiving a power of a motor, not shown, while being guided by a guide shaft (not shown) extending in the scanning direction of the printhead 17 (primary scanning direction: the front and reverse direction of the paper of FIGS. 11A to 11E) and a guide panel (not shown) extending in the same manner in the primary scanning direction.

An air suction unit 32 (see FIGS. 11A to 11E) as a paper suction device is provided on the downstream side of the printhead 17, and the air suction unit 32 (see FIGS. 11A to 11E) places the roll paper P on the downstream side of the printhead 17 in a constrained state so as not to be lifted, so that lowering of the printing quality due to the lifting of the roll paper P is prevented.

Figure 2:
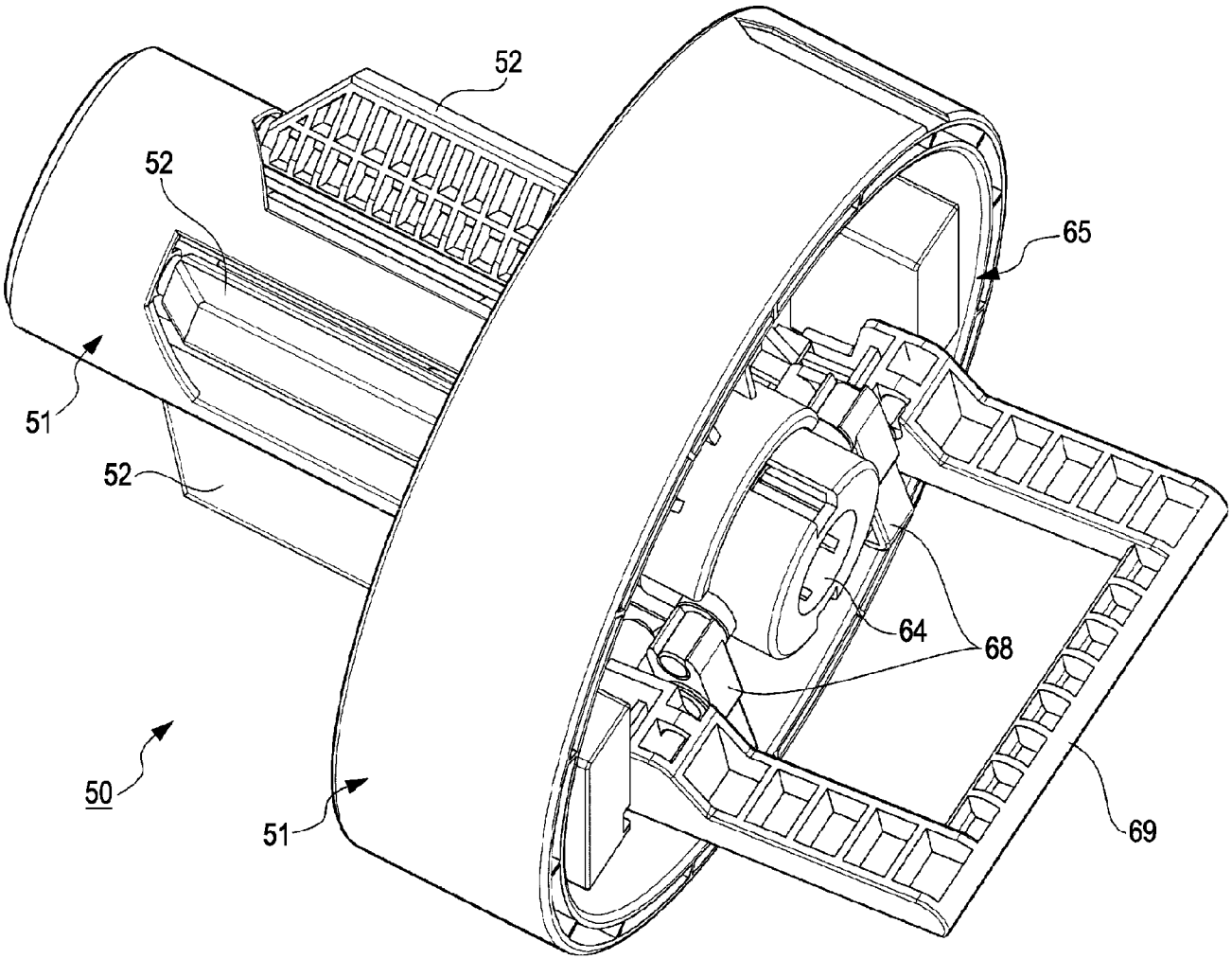
FIG. 2 is a general perspective view showing a roll paper holder according to the embodiment of the invention.
Figure 3:
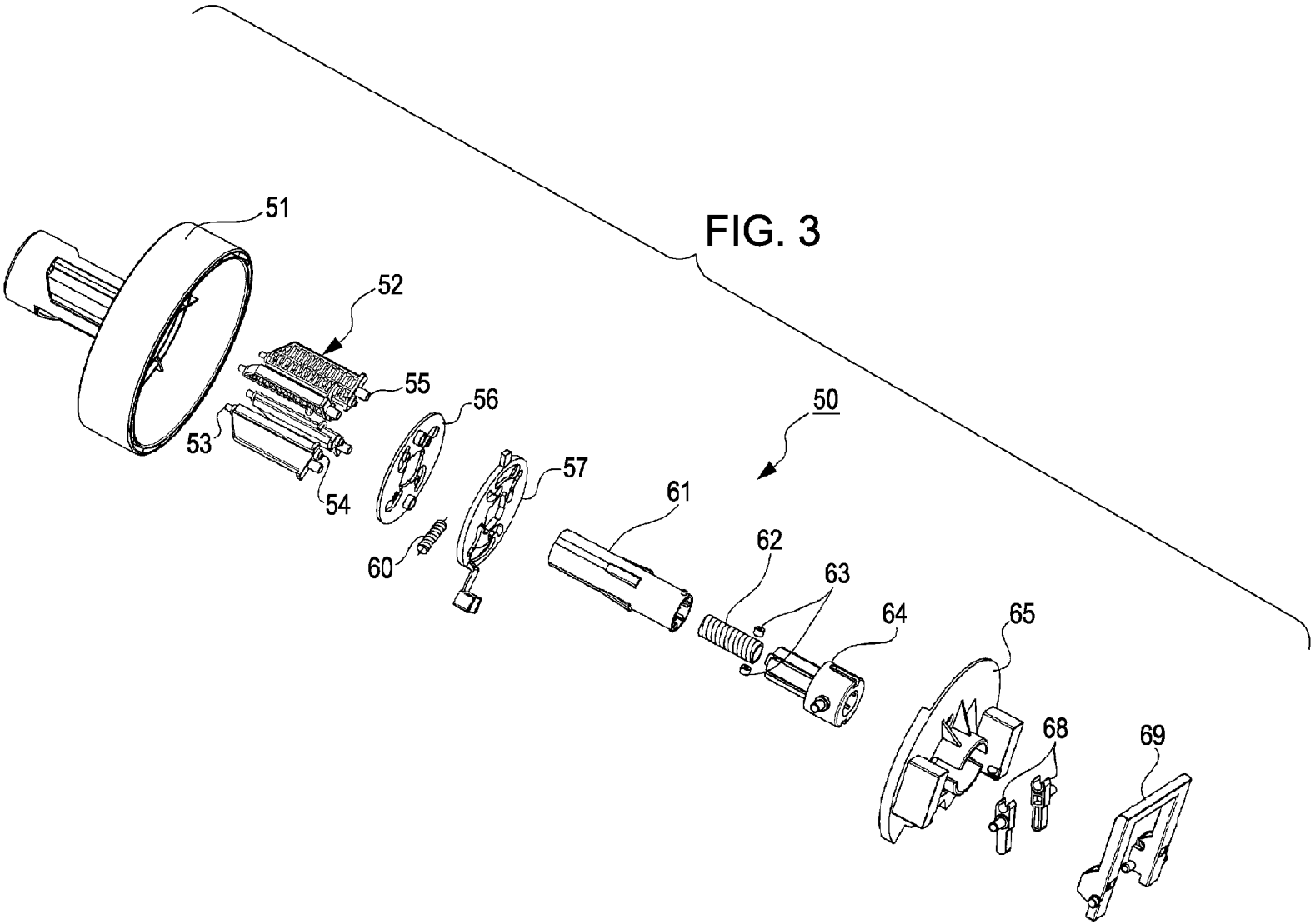
FIG. 3 is an exploded perspective view showing the roll paper holder according to the embodiment of the invention.

FIG. 2 is a general perspective view showing a roll paper holder as a roll medium supporting apparatus according to an embodiment of the invention. FIG. 3 is an exploded perspective view of FIG. 2.

As shown in FIG. 2 and FIG. 3, the roll paper holder 50 includes a holder unit 51 as a base body portion, and a plurality of contact supporting portions 52, 52, . . . which are capable of coming into contact with the inner peripheral surface of roll shaft portions (R2, R3 (see FIG. 6A and FIG. 7A) of the roll paper P. The contact supporting portions 52, 52, . . . are provided so as to be capable of rotating about first supporting shaft 53, 53 . . . and second supporting shaft 54, 54, . . . provided coaxially with each other as pivots. Specifically, the first supporting shaft 53, 53, . . . are supported by the holder unit 51 so as to be capable of rotating and the second supporting shaft 54, 54, . . . on one side are supported by a stopper 56 so as to be capable of rotating.

Projections 55, 55, . . . of the contact supporting portions 52, 52, . . . are provided at different positions from the first supporting shaft 53, 53, . . . and the second supporting shaft 54, 54, . . . in the radial direction of the pivots, and engage grooves 58, 58, . . . provided on a cam lever 57. Furthermore, one end of a tension spring 60 engages the cam lever 57 and the other end engages a cover member 65.

Also, one end of a compression spring 62 engages the distal end of a slider member 64, and the other end engages a wedge member 61. Spacers 63, 63, . . . are provided for stabilizing the position of the compression spring 62.

The cover member 65 is provided to cover the stopper 56, the cam lever, and so on mounted to the holder unit 51. Furthermore, one ends of a pair of link portions 68, 68 engage the slider member 64 so as to be capable of rotating, and the other ends engage a lever unit 69 so as to be capable of rotating. The lever unit 69 engages the outside of the cover member 65 so as to be capable of rotating. In other words, so-called a toggle clamp is configured by the lever unit 69, the link portions 68, 68, the cover member 65, the slider member 64, and the compression spring 62.

When the lever unit 69 is opened so as to bring the lever unit 69 away from the cover member 65, the slider member 64 is pulled outwardly of the cover member 65, and is moved thereby. In contrast, when the lever unit 69 is closed so as to approach the cover member 65, the slider member 64 is pushed inwardly of the cover member 65, and is moved thereby. At this time, the slider member 64 moves the wedge member 61 inwardly via the compression spring 62. The wedge member 61 is provided with wedge shaped projections. When it is moved inwardly, the projections are able to widen the contact supporting portions 52, 52, . . . slightly radially outwardly of roll shaft portions (R2, R3). Therefore, the contact supporting portions 52, 52, . . . can be pressed against the inner peripheral surfaces of the roll shaft portions (R2, R3).

Here, the pressing force is determined by an urging force of the compression spring 62. Specifically, when the lever unit 69 is closed, the wedge member 61 is moved inwardly. At this time, when the contact supporting portions 52, 52, . . . press the inner peripheral surfaces of the roll shaft portions (R2, R3) sufficiently, the inward movement of the wedge member 61 is stopped, the compression spring 62 is contracted, and only the slider member 64 moves inwardly. Consequently, the contact supporting portions 52, 52, . . . may be pressed against the inner peripheral surfaces of the roll shaft portions (R2, R3) with a desired force.

Figure 4A:
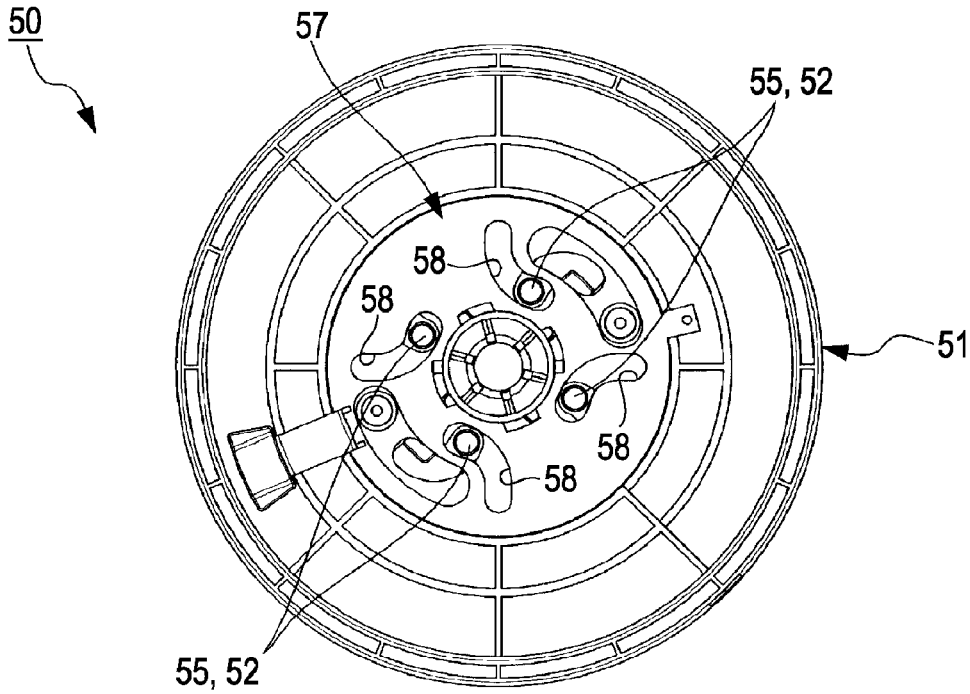
FIG. 4A is a plan view of contact supporting portions positioned in a first position.
Figure 4B:
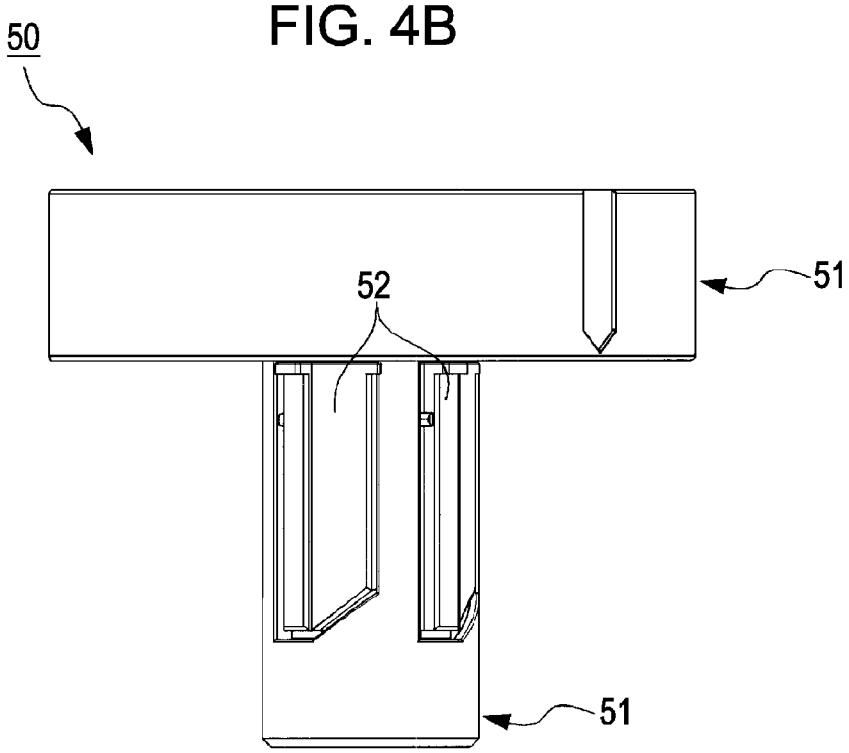
FIG. 4B is a side view of the contact supporting portions positioned in the first position.

FIGS. 4A and 4B show the contact supporting portions in a first position. FIG. 4A is a plan view and FIG. 4B is a side view.

Figure 5A:
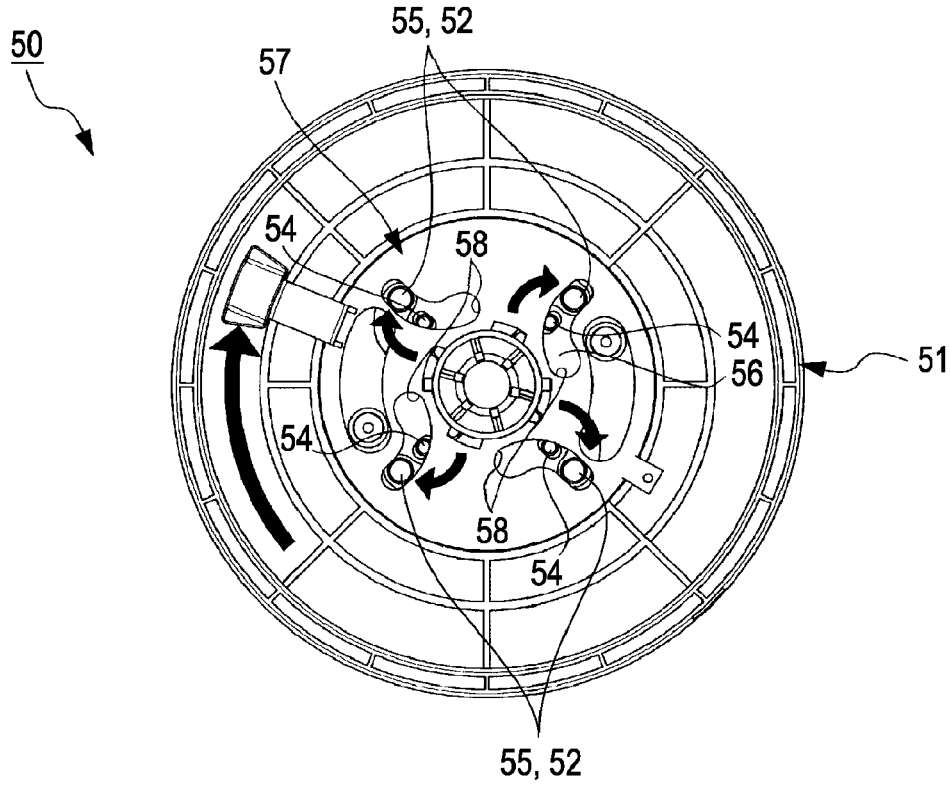
FIG. 5A is a plan view of the contact supporting portions positioned in a second position.
Figure 5B:
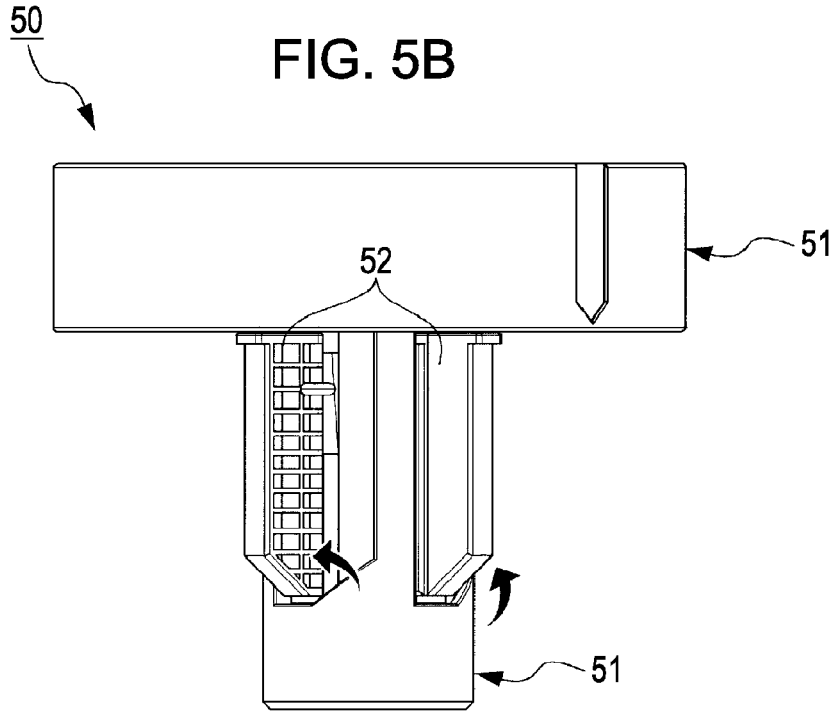
FIG. 5B is a side view of the contact supporting portions positioned in the second position.

FIGS. 5A and 5B show the contact supporting portions in a second position. FIG. 5A is a plan view and FIG. 5B is a side view.

In FIGS. 4A and 4B and FIGS. 5A and 5B, illustration of the cover member and the lever member is omitted for facilitating understanding of the interior of the roll paper holder.

As shown in FIG. 4A and FIG. 4B, when the cam lever 57 is positioned at a counterclockwise end of the rotatable range, the grooves 58, 58, . . . of the cam lever 57 hold the projections 55, 55, . . . of the contact supporting portions 52, 52, . . . at radially inner positions. At this time, the contact supporting portions 52, 52, . . . are in the closed state with respect to the holder unit 51, that is, positioned radially inward. In the embodiment of the invention, the positions of the contact supporting portions 52, 52, . . . described above are referred to as the first position.

As shown in FIGS. 5A and 5B, when the cam lever 57 is rotated clockwise in FIG. 5A, the projections 55, 55, . . . of the contact supporting portions 52, 52, . . . are guided by the grooves 58, 58, . . . of the cam lever 57 and moves radially outward. At this time, the contact supporting portions 52, 52, . . . rotate about the first supporting shaft 53, 53, . . . and the second supporting shaft 54, 54, . . . as pivots. Therefore, the contact supporting portions 52, 52, . . . are in the opened state with respect to the holder unit 51, that is, positioned radially outward. In the embodiment of the invention, the positions of the contact supporting portions 52, 52, . . . described above are referred to as the second position.

Figure 6A:
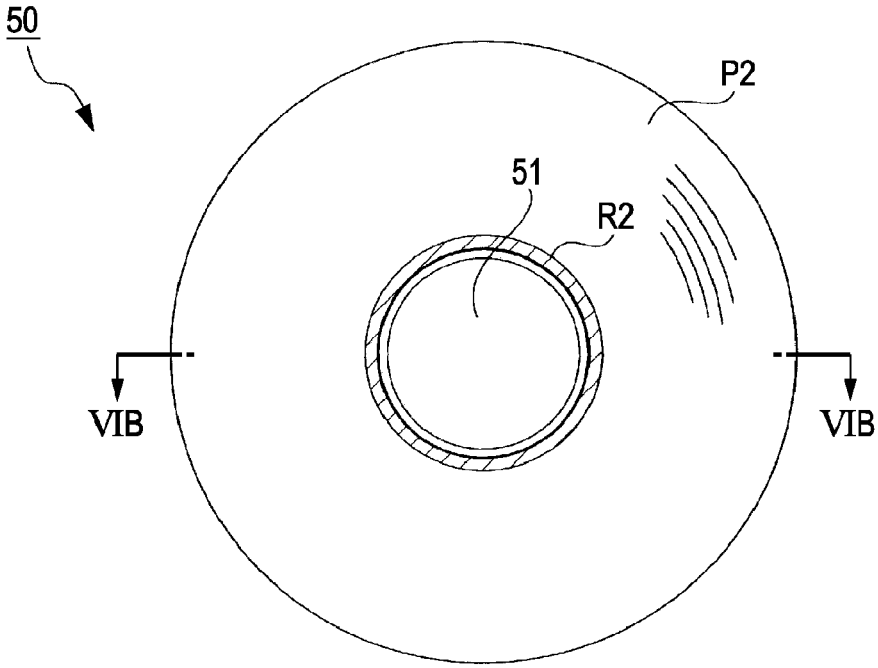
FIG. 6A and FIG. 6B illustrate a roll paper of 2 inches set in the roll paper holder.
Figure 6B:
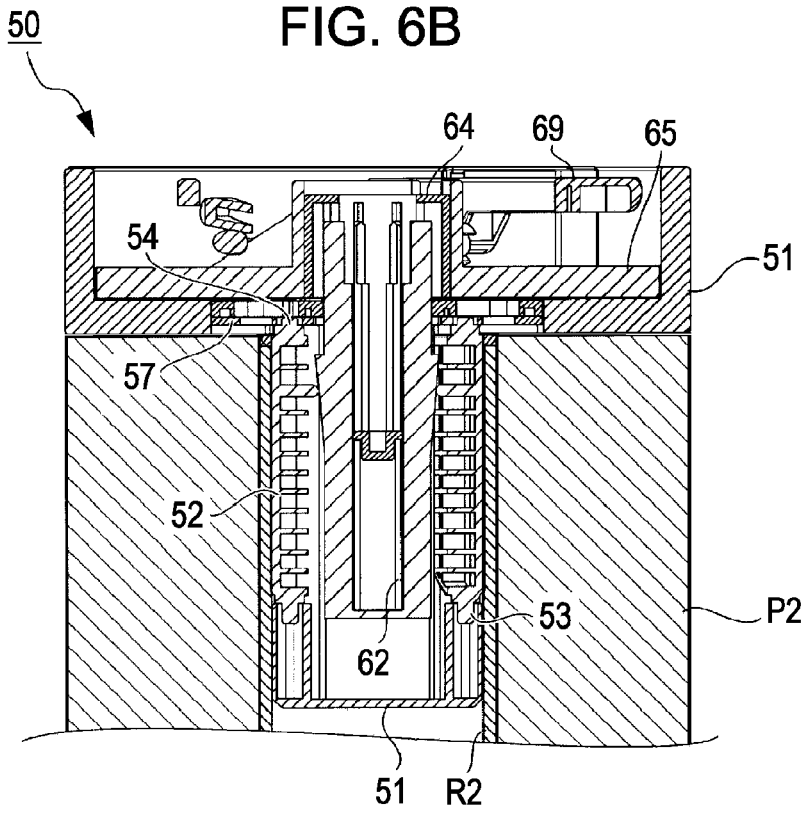

FIGS. 6A and 6B illustrate a roll paper of 2 inches set in the roll paper holder. FIG. 6A is a plan cross-sectional view viewed from the inside, and FIG. 6B is a side cross-sectional view taken along the line VIB-VIB in FIG. 6A.

Figure 7A:
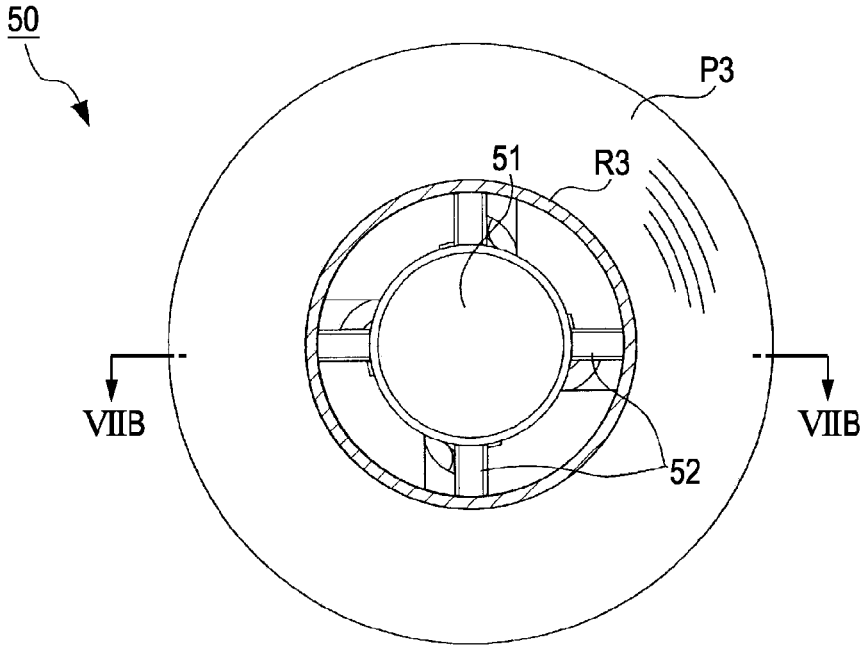
FIG. 7A and FIG. 7B illustrate a roll paper of 3 inches set in the roll paper holder.
Figure 7B:
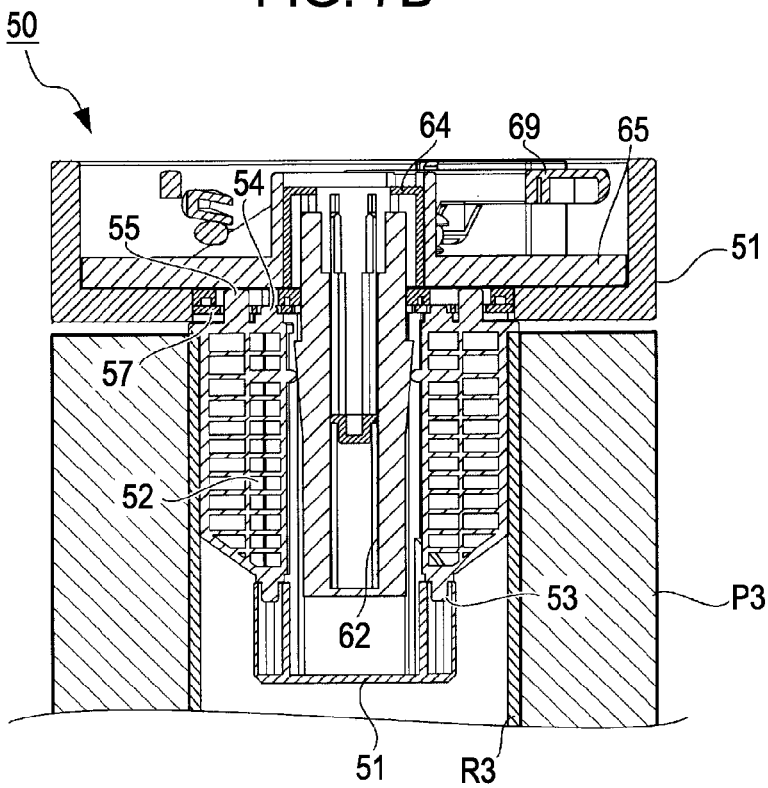

FIGS. 7A and 7B illustrate a roll paper of 3 inches set in the roll paper holder. FIG. 7A is a plan cross-sectional view viewed from the inside, and FIG. 7B is a side cross-sectional view taken along the line VIIB-VIIB in FIG. 7A.

As shown in FIGS. 6A and 6B, when the contact supporting portions 52, 52, . . . assume the first position, a roll paper P2 of 2 inches can be set in the roll paper holder 50.

As a detailed procedure, first of all, the lever unit 69 is brought into an opened state. Therefore, a state in which the wedge member 61 does not act on the contact supporting portions 52, 52, . . . is achieved.

Subsequently, the cam lever 57 is rotated to the counterclockwise end within the rotatable range as shown in FIG. 4A. Therefore, the contact supporting portions 52, 52, . . . assume the first position.

Subsequently, the distal end side as a thin portion of the holder unit 51 is inserted into a hollow portion of a roll shaft R2 of 2 inches of the roll paper P2 of 2 inches. Then, the lever unit 69 is closed. Consequently, the wedge member 61 acts on the contact supporting portions 52, 52, . . . and widens the contact supporting portions 52, 52, . . . radially outward. Therefore, a state in which there is no clearance between the inner peripheral surface of the roll shaft R2 of 2 inches and the contact supporting portions 52, 52, . . . is achieved. Then, the contact supporting portions 52, 52, . . . may be pushed against the inner peripheral surface of the roll shaft R2 with a desired force. Consequently, the roll paper holder 50 is able to hold the roll paper P2 of 2 inches firmly. Therefore, there is no risk of occurrence of slippage between the inner peripheral surface of the roll shaft R2 of 2 inches and the contact supporting portions 52, 52.

As shown in FIGS. 7A and 7B, when the contact supporting portions 52, 52, . . . assume the second position, a roll paper P3 of 3 inches can be set in the roll paper holder 50.

As a detailed procedure, the lever unit 69 is brought into an opened state as in the case of setting the roll paper P2 of 2 inches described above.

Subsequently, the cam lever 57 is rotated to a clockwise end within the rotatable range as shown in FIG. 5A. Therefore, the contact supporting portions 52, 52, . . . assume the second position.

Subsequently, the distal end side as the thin portion of the holder unit 51 is inserted into the hollow portion of a roll shaft R3 of 3 inches of the roll paper P3 of 3 inches. Then, the lever unit 69 is closed. Therefore, a state in which there is no clearance between the inner peripheral surface of the roll shaft R3 of 3 inches and the contact supporting portions 52, 52, . . . is achieved. Then, the contact supporting portions 52, 52, . . . may be pushed against the inner peripheral surface of the roll shaft R3 with a desired force. Consequently, the roll paper holder 50 holds the roll paper P3 of 3 inches firmly. Therefore, there is no risk of occurrence of slippage between the inner peripheral surface of the roll shaft R3 of 3 inches and the contact supporting portions 52, 52.

Figure 8:
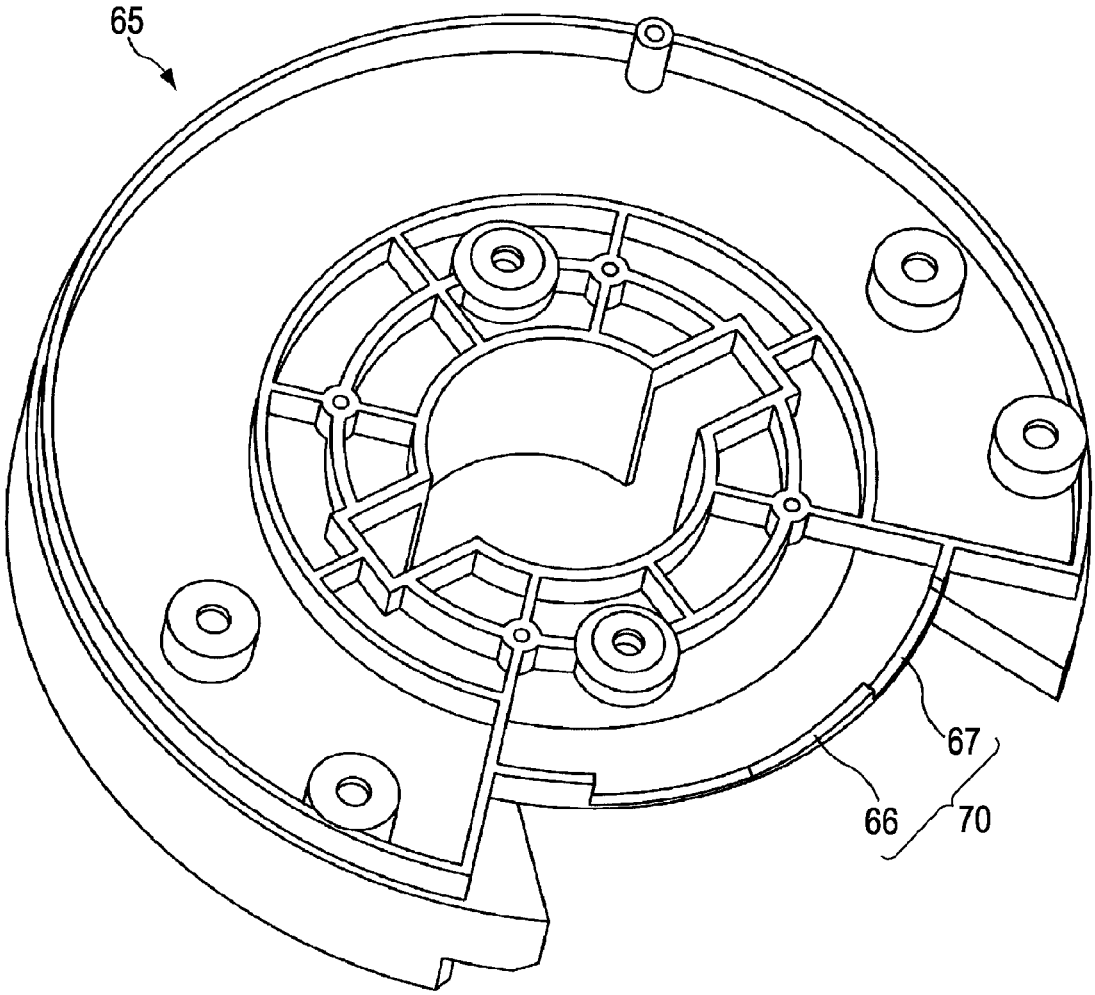
FIG. 8 is a perspective view of a cover member according to the embodiment of the invention viewed from the inside.

FIG. 8 is a perspective view of a cover member according to the embodiment of the invention viewed from the inside.

As show in FIG. 8, the roll paper holder 50 has a stabilizing mechanism 70 for stabilizing the positions of the contact supporting portions 52, 52, . . . at predetermined positions. Specifically, the cover member 65 includes a recessed portion 67 and an inclined portion 66 as an engaging portion which is engageable with the cam lever 57 in the predetermined positions.

Here, the term "predetermined position" means positions that the contact supporting portions 52, 52, . . . are able to assume according to the sizes of the roll shaft portions (R2, R3). Specifically, it includes the first position and the second position in the embodiment. The predetermined positions are not limited to the two positions describe above. When there are many sizes of roll shaft portions (R2, R3 . . . ), a number of the predetermined positions are to be provided according to the sizes, as a matter of course. Although the recessed portion 67 is provided so as to engage the cam lever 57 at the second position, it is also possible to provide another recessed portion so as to engage the cam lever 57 at the first position.

The inclined portion 66 is provided so as to be inclined with respect to the direction of rotation of the cam lever 57.

Figure 9A:
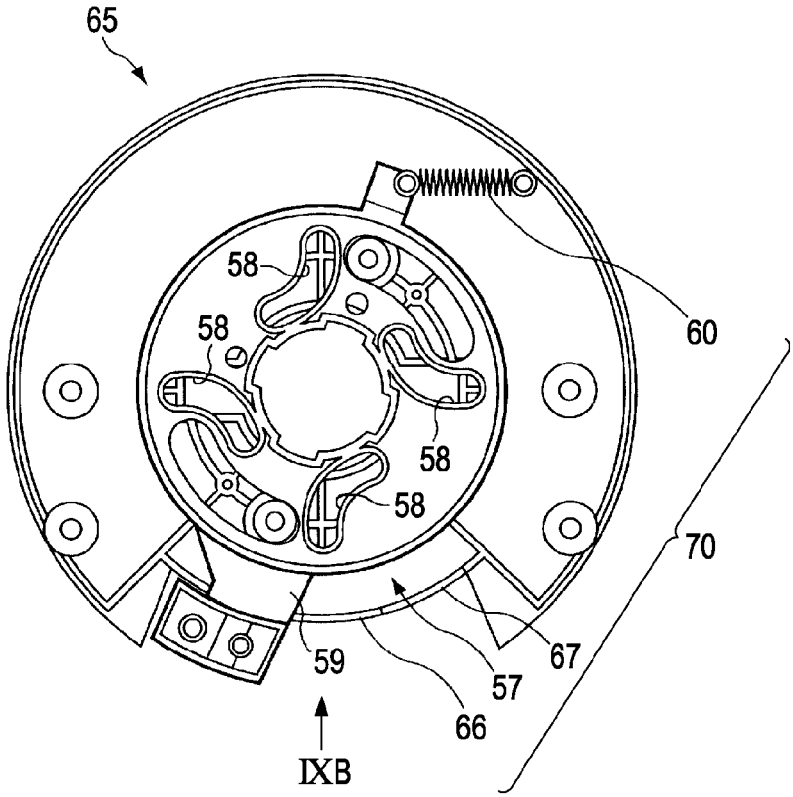
FIG. 9A and FIG. 9B illustrate a cam lever at a first position.
Figure 9B:
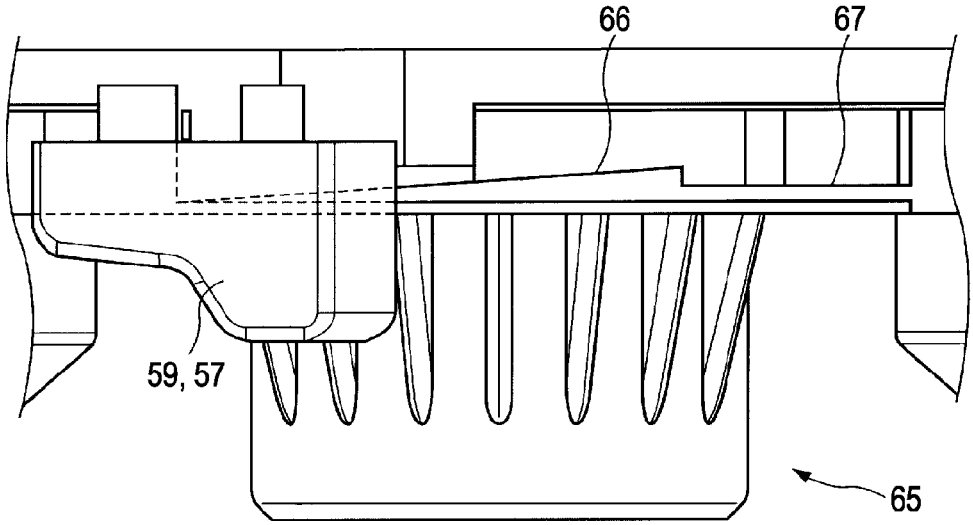

FIGS. 9A and 9B illustrate the cam lever in a state in which the contact supporting portions are at the first position. FIG. 9A is a plan view of the cover member and the cam lever viewed from inside the cover member. FIG. 9B is an enlarged side view of a principal portion of FIG. 9A viewed in the direction indicated by an arrow IXB. As shown in FIGS. 9A and 9B, the stabilizing mechanism 70 includes the cam lever 57, the inclined portion 66, the recessed portion 67, and the tension spring 60.

When the contact supporting portions 52, 52, . . . are at the first position, a lever arm 59 of the cam lever 57 is positioned at a lower portion of the inclined portion 66. At this time, the cam lever 57 is urged clockwise in FIG. 9A by the tension spring 60.

Therefore, the cam lever 57 is held stably at the clockwise end within the rotatable range in FIG. 9A. In other words, the stabilizing mechanism 70 is able to hold the contact supporting portions 52, 52, . . . stably at the first position.

Figure 10A:
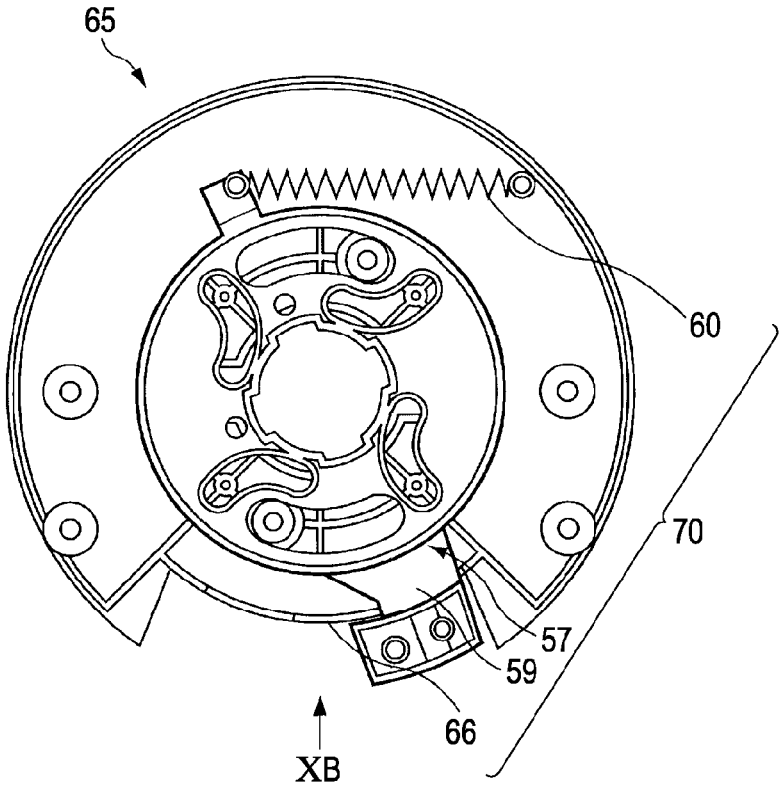
FIG. 10A and FIG. 10B illustrate the cam lever at a second position.
Figure 10B:
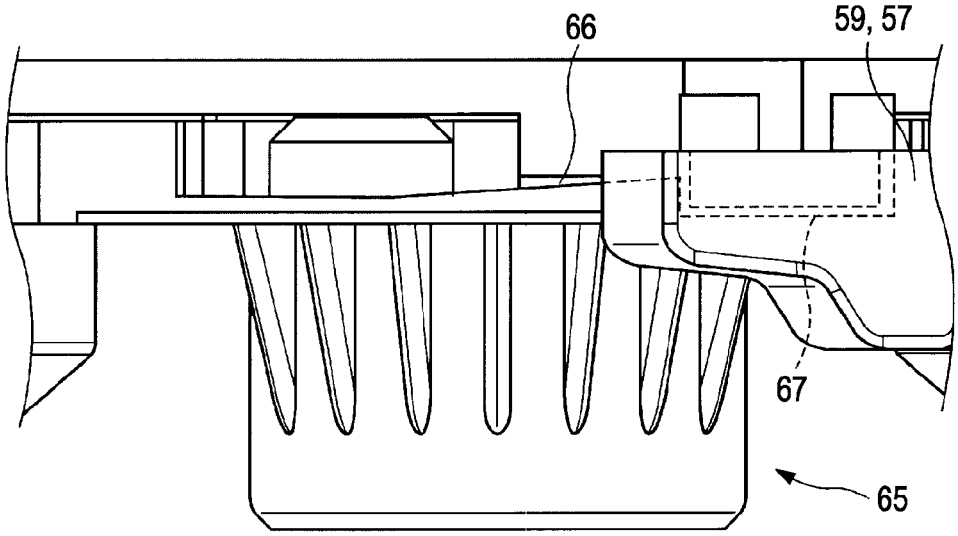

FIGS. 10A and 10B illustrate the cam lever in a state in which the contact supporting portions are at the second position. FIG. 10A is a plan view of the cover member and the cam lever viewed from inside the cover member. FIG. 10B is an enlarged side view of a principal portion of FIG. 10A viewed in the direction indicated by an XB.

As shown in FIGS. 10A and 10B, an user rotates the cam lever 57 in counterclockwise in FIG. 10A against the urging force of the tension spring 60.

At this time, the lever arm 59 moves upward the inclined portion 66 while deflecting in the axial direction of the axis of rotation. Then, when the lever arm 59 opposes the recessed portion 67, it is able to engage the recessed portion 67 using the deflection of the lever arm 59.

There, the recessed portion 67 is provided at a position where the contact supporting portions 52, 52, . . . assume the second position.

Therefore, the stabilizing mechanism 70 is able to hold the contact supporting portions 52, 52, . . . stably at the second position.

When moving the contact supporting portions 52, 52, . . . from the second position to the first position, the user presses the lever arm 59 to the inside the cover member 65, which corresponds to the upper side of the FIG. 10B. Then, engagement between the lever arm 59 and the recessed portion 67 is released. Then, with the urging force of the tension spring 60, the lever arm 59 rotates clockwise in FIG. 10A. Consequently, the lever arm 59 moves downward along the inclined portion 66, and the cam lever 57 assumes the state shown in FIG. 9A.

Although the predetermined positions of the contact supporting portions 52, 52, . . . are described to be two positions of the first position and the second position, a number of predetermined positions may be provided corresponding to the types of the sizes of the roll shaft portions (R2, R3 . . . ). In such a case, the number of the inclined portion 66 and the recessed portion 67 may be increased in the direction of rotation.

Although the operation of the lever arm 59 is switched by the manual operation of the user in this embodiment, it may be switched automatically as a matter of course.

Skew Correction

FIGS. 11A to 11E show side views showing respective processes of a method of skew correction.

A printed material transport apparatus 80 of the invention includes the spindle motor 30 as a rotational drive unit for rotating a spindle 81 which supports the roll paper P, a transport roller 21 including the transport drive roller 23 and the transport driven roller 24 for nipping a leading end 40 of the roll paper P as printed material delivered from a roll portion 31 of the roll paper P, a nip-release position switching unit (not shown) for switching the position of the transport driven roller 24 between the nip position and the release position, the air suction unit 32 for adsorbing the roll paper P passing on the platen 28 by for example, suction by air, a leading end detection sensor 33 provided on the lower surface of a carriage 82 in the vicinity of the printhead 17, and a control unit 34 executing the skew correction control of the roll paper P on the basis of leading end position data of the roll paper P detected by the leading end detection sensor 33.

The spindle motor 30 is a motor connected to the spindle 81 for rotating the roll paper P mounted on the spindle 81 in the normal direction and the reverse direction. The transport driven roller 24 is able to move between the nipping position for cooperative rotation with the transport drive roller 23 in contact with each other and the release position for being away from the transport drive roller 23. Then, switching between the nip position and the release position of the transport driven roller 24 is achieved by a manual lever, a change-over switch, or automatic operation of the nip-release position switching unit (not shown).

The air suction unit 32 includes a suction hole 35 formed on the platen 28, an air suction route 36 connected at one end to the suction hole 35, and an air suction fan 37 connected to the other end of the air suction route 36. An air suction force by the air suction fan 37 is configured to be variable between the skew correction of the roll paper P and the transport of the roll paper P. Specifically, the air suction force is increased for the skew correction of the roll paper P because a larger force is necessary for the skew correction than for the print and the transport of the roll paper P.

The leading end detection sensor 33 is a position sensor for detecting the leading end 40 of the roll paper P which passes through a printing position 26 or is returned to the printing position 26.

The control unit 34 is a device for bringing the transport driven roller 24 into the released state on the basis of the leading end position data of the roll paper P detected by the leading end detection sensor 33 and controlling the skew correction, and the skew correction of the printed material in the embodiment of the invention shown below is carried out on the basis of the skew correction control. In the following description, the method of skew correction of the printed material according to the embodiment of the invention will be described separately for (1) a case of using a high-rigidity printed material and (2) a case of using a low-rigidity printed material.

(1) When Transporting the High-rigidity Printed Material (See FIGS. 11A to 11E)

Figure 11A:
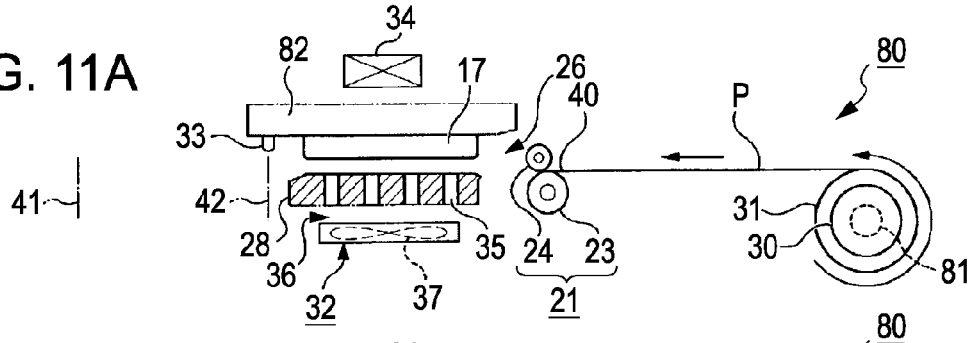
FIG. 11A to FIG. 11E illustrate skew correcting operation.
Figure 11B:
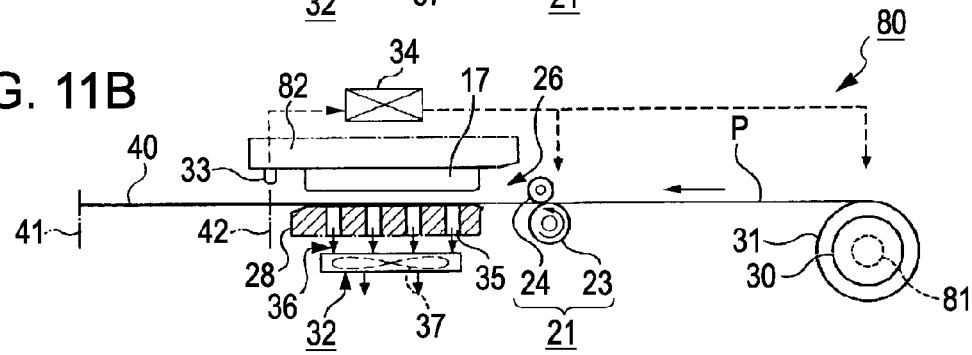
Figure 11C:
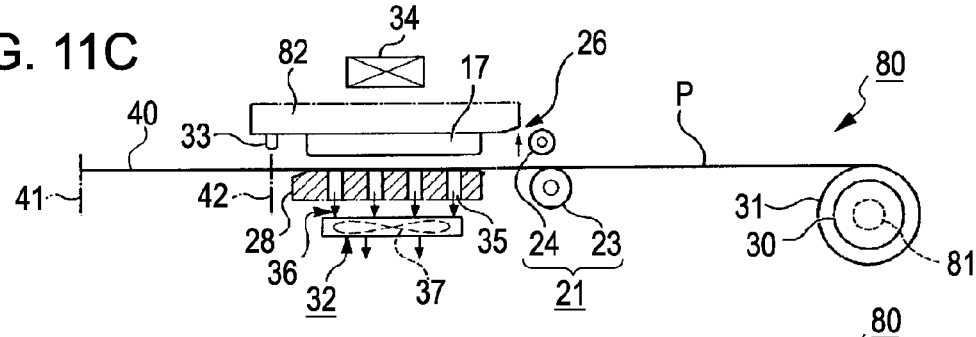
Figure 11D:
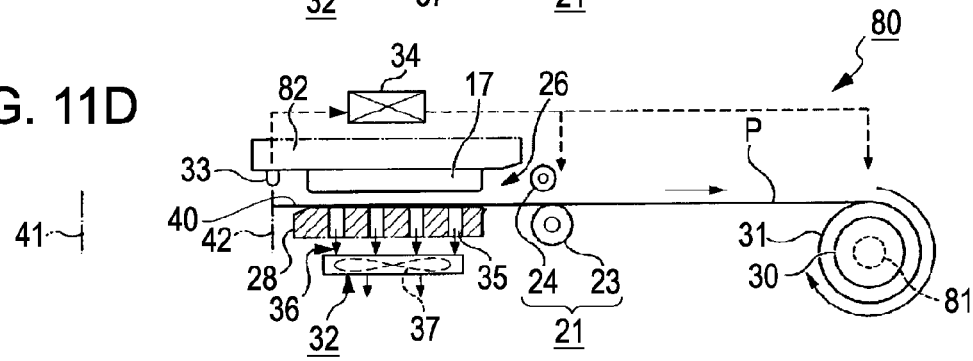
Figure 11E:
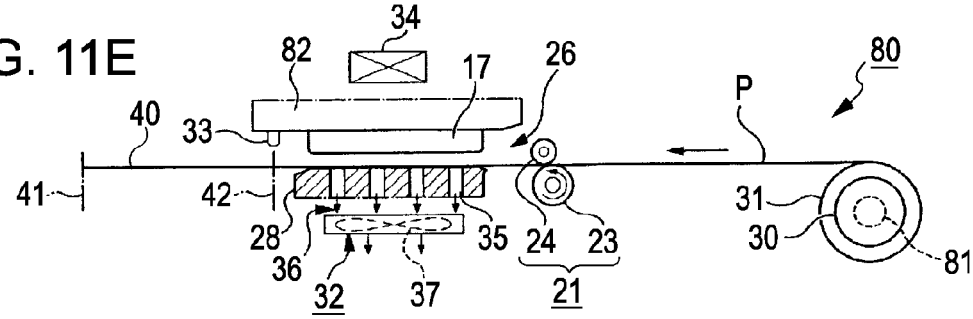

The method of skew correction of the printed material in the embodiment includes execution of a preliminarily transporting process shown in FIG. 11A, a skew correction preparing process shown in FIG. 11B, a nipped state releasing process shown in FIG. 11*c*, and a skew correcting process shown in FIG. 11D in sequence, and after having corrected the skew, the procedure goes to a printing process shown in FIG. 11E.

The preliminarily transporting process is a process of transporting the leading end 40 of the roll R until it comes into contact with the transport roller 21 in the nipped state. In this process, the transport of the roll paper P is achieved, for example, by rotating the spindle motor 30 in the normal direction. The skew correction preparing process is a process of transporting the leading end 40 of the roll paper P transported to the nipping position to a delivering position 41 on the downstream of the printing position 26. In this process, the transport of the roll paper P is achieved, for example, by rotating the transport drive roller 23 in the normal direction.

The delivering position 41 is set on the basis of the leading end position detecting data detected by the leading end detection sensor 33. In this process, the air suction fan 37 in the air suction unit 32 is turned ON, and the roll paper P passing over the platen 28 is transported to the delivering position 41 while being adsorbed. In this configuration, the roll paper P having a high rigidity on the platen 28 is prevented from being lifted while being transported thereon.

The nipped state releasing process is a process of switching the transport driven roller 24 into the release position when the leading end 40 of the roll paper P reaches the delivering position 41 and releases the nipped state of the transport roller 21. This process is executed by using the nip-release position switching unit (not shown), and the air suction fan 37 is still in the ON-state during the execution of this process. The skew correcting process is a process of correcting the skew of the roll paper P by rotating the spindle motor 30 in the reverse direction and rewinding the leading end 40 of the roll paper P reached to the delivering position 41, and then returning to a stop position 42 near the printing position 26.

In this process, the transport roller 21 is in the released state. However by turning the air suction fan 37 ON and increasing the air suction force to a level larger than during the transport as described above, a tension is provided on the roll paper P, so that the skew correction of the roll paper P is achieved. The setting of the stop position 42 is carried out on the basis of the leading end position data detected by the leading end detection sensor 33. Then, the roll paper P whose skew is corrected without receiving a clamping force from the transport roller 21 is proceeded to the printing process shown in FIG. 11E without being damaged on the printed surface on the front side and the transported surface on the back side. The air suction force of the air suction fan 37 in the printing process is set to be smaller than that during the skew correction.

(2) When the Printed Material Having a Low-rigidity (Not Shown)

The skew correction preparing process is a process of transporting the leading end 40 of the roll paper P transported to the nipping position to the delivering position 41 on the downstream of the printing position 26 as the skew correction preparing process shown in FIG. 11B. In this process, the transport of the roll paper P is achieved, for example, by rotating the transport drive roller 23 in the normal direction, and the delivering position 41 is set also on the basis of the leading end position detection data detected by the leading end detection sensor 33 as in the skew correction preparing process shown in FIG. 11B. However, in the case of the roll paper P having a low rigidity, since lifting of the roll paper P when passing over the platen 28 does not occur, the air suction fan 37 in the air suction unit 32 is kept in the OFF-state.

The nipped state releasing process is a process to switch the transport driven roller 24 into the release position when the leading end 40 of the roll paper P reaches the delivering position 41 and releases the nipped state of the transport roller 21 as the nipped state releasing step shown in FIG. 1C. In this process, the air suction fan 37 in the air suction unit 32 is turned ON, and after having brought the air suction fan 37 ON, the transport driven roller 24 is switched to the release position. Then, the skew correcting process as that shown in FIG. 11D is carried out to correct the skew of the roll paper P, so that the procedure goes to the printing process like the process shown in FIG. 11E without giving damage to the printed surface and the transported surface of the roll paper P.

Detection of Remaining Amount of Roll Paper

Figure 12:
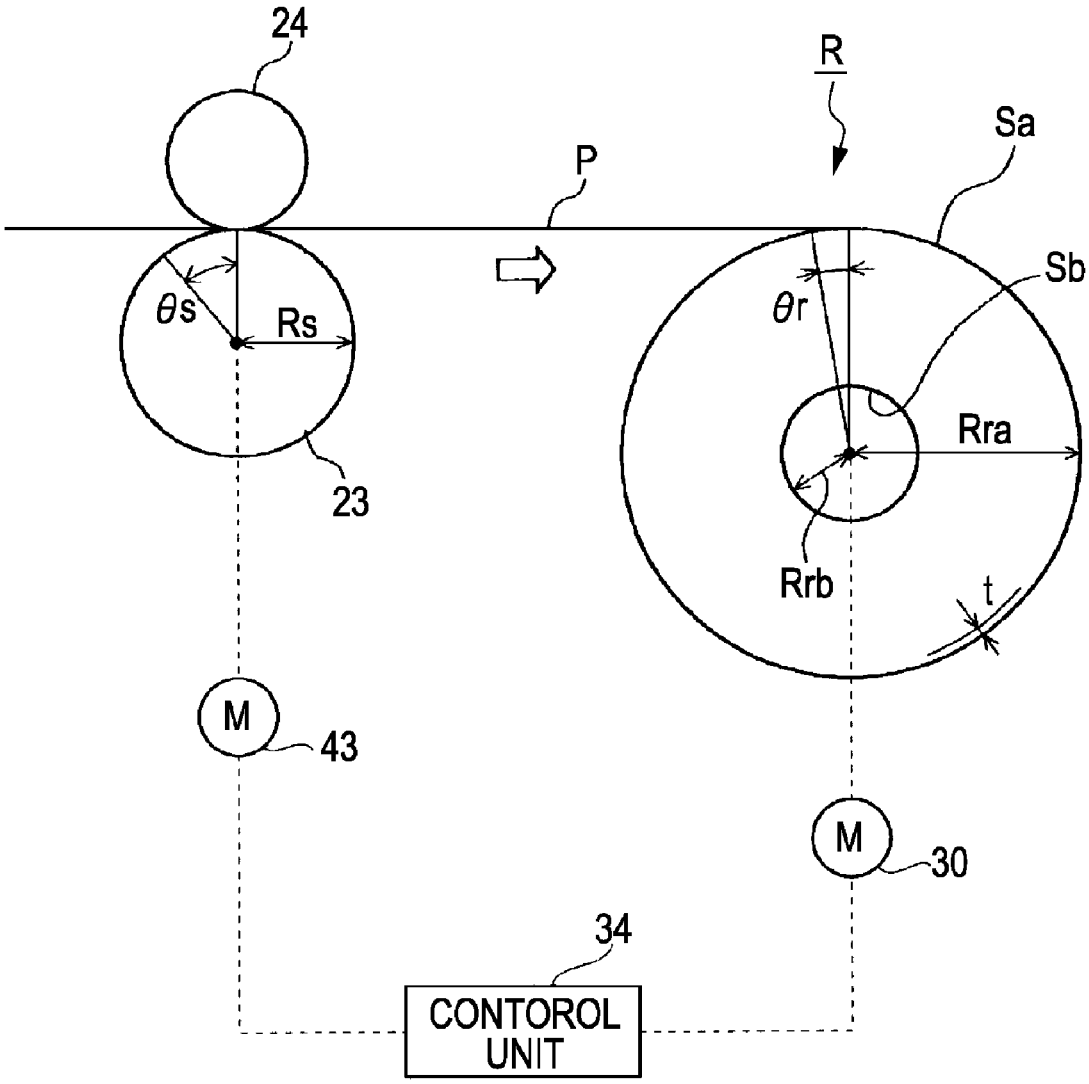
FIG. 12 is a side view showing operation to detect the remaining amount of the roll paper.

FIG. 12 shows parameters required for calculating the remaining amount of roll paper such as a roll radius, a transfer roller radius, and so on.

The control unit 34 includes a winding control mode which controls the spindle motor 30 as the roll drive unit and a transport motor 43 as the transport roller drive unit and provides a rotational force for winding the roll paper P on the roll R and the transport drive roller 23 without being sagged between the roll R and the transport drive roller 23, and when calculating the remaining amount of the roll paper, the control mode is executed.

More specifically, in the control mode, a rotational power for feeding the roll paper P in the winding direction at a feeding velocity $V_1$ is provided to the transport drive roller 23, and a rotational power for winding the roll paper P at a velocity $V_2$ faster than the feeding velocity $V_1$ is provided to the roll R.

The rewinding velocity $V_2$ of the roll paper P by the roll R is a winding velocity assuming that the transport drive roller 23 is not present. However, actually, since the feeding force of the roll paper P by the transport drive roller 23 (the frictional force between the transport drive roller 23 and the roll paper P) is set to a large value, the winding velocity of the roll paper P (the length of the roll paper P wound in a unit time) depends on the number of revolution of the transport drive roller 23, and the winding velocity of the roll paper P becomes the velocity $V_1$.

Referring now to FIG. 12, further detailed description will be given below. In FIG. 12, reference sign Rra designates the radius of an outer periphery Sa of the roll paper P, reference sign Rrb designates a radius of an inner periphery Sb of the roll paper P wound on the roll R, reference sign t designates the thickness of the roll paper P, reference sign Rs designates the radius of the outer periphery of the transport drive roller 23. Reference sign θs designates the rotational angle of the transport drive roller 23, and reference sign θr designates the angle of rotation of the roll R when the transport drive roller 23 rotates by the angle of rotation θs.

The feeding amount of the roll paper P by the transport drive roller 23 is obtained from Rs×θs, the winding amount of the roll paper P by the roll R (or unwound amount, on the contrary) is obtained from Rra×θr, and since these are equal, the radius Rra of the roll R is obtained from Rra=Rs×(θs/θr).

Subsequently, in FIG. 12, since the surface area of the roll paper P wound on the roll R is obtained from $\pi\times(Rra^2-Rrb^2)$, where π is a pi-times function, the length L of the roll paper P wound on the roll R is obtained from the expression (1) shown below;

$L=\pi\times(Rra^2-Rrb^2)/t$ . . . (1). Accordingly, the length L of the roll paper P wound on the roll R is obtained on the basis of the angle of rotation θs of the transport drive roller 23 and the angle of rotation θr of the roll R.

As described above, the detection of the remaining amount of the roll paper is carried out while winding the roll paper P mainly by the roll R. Accordingly, slippage between the transport drive roller 23 and the roll paper P is prevented, so that the remaining amount of the roll paper P can be calculated further accurately.

The roll paper holder 50 as the roll medium supporting apparatus in this embodiment includes the holder unit 51 as the base body portion to be inserted into the roll shaft portion R2 of 2 inches and the roll shaft portion R3 of 3 inches as a hollow shaft portion of the roll paper P as an example of the rolled medium, the plurality of contact supporting portions 52, 52, . . . being provided circumferentially of the holder unit 51 so as to be displaceable radially of the roll shaft portion R2 of 2 inches and the roll shaft portion R3 of 3 inches, having a plurality of predetermined positions within the displaceable range, and supporting the inner peripheral surfaces of the roll shaft portion R2 of 2 inches and the roll shaft portion R3 of 3 inches by coming into contact therewith, and the stabilizing mechanism 70 configured to stabilize the contact supporting portions 52, 52, . . . in the plurality of predetermined positions.

In this embodiment, the stabilizing mechanism 70 includes the cam lever 57 as the lever unit 69 for radially displacing the plurality of contact supporting portions 52, 52, . . . , the tension spring 60 as an example of the urging unit configured to urge the cam lever 57 in the one direction of the rotatable direction of the cam lever 57, and the recessed portion 67 as an example of the engaging portion being engageable with the lever arm 59 of the cam lever 57 when the cam lever 57 is located at a position other than the downstream end of the urging direction of the tension spring 60 within the rotatable range of the cam lever 57, and when the contact supporting portions 52, 52, . . . are at the predetermined positions.

In addition, in this embodiment, the tension spring 60 as an example of the urging unit urges the cam lever 57 toward the position of the cam lever 57 assumed when the plurality of contact supporting portions 52, 52, . . . are contracted in the radial direction.

In this embodiment, the contact supporting portions 52, 52, . . . are configured to be rotated integrally with the holder unit 51 by power of the spindle motor 30 as an example of the motor.

The ink jet printer 1 as an example of the printing apparatus in this embodiment includes the roll paper supply unit 3 as a feeding unit configured to feed the roll paper P as an example of the printed medium, and the print executing unit 4 as the printing unit configured to execute the printing job by the printhead 17 on the roll paper P fed from the roll paper supply unit 3, and the roll paper supply unit 3 includes the roll paper holder 50.

The invention is not limited to the embodiment described above, and various modifications may be made within the scope of the invention described in the appended claims and, needless to say, such modifications are also included in the invention.

What is claimed is:

1. A roll medium supporting apparatus comprising:

a base body portion to be inserted into a hollow shaft portion of a rolled medium;

a plurality of contact supporting portions provided circumferentially of the base body portion so as to be capable of being displaced radially of the hollow shaft portion, having a plurality of predetermined positions within the displaceable range, and coming into contact with the inner peripheral surface of the hollow shaft portion and supporting the same; and a stabilizing mechanism configured to stabilize the contact supporting portions at the plurality of predetermined positions, wherein the stabilizing mechanism comprises a lever member configured to displace the plurality of contact supporting portions in the radial direction, an urging unit configured to urge the lever member in one direction of the direction of rotation of the lever member, and an engaging portion being capable of engaging the lever member when the lever member is positioned at a position other than the downstream end in the urging direction of the urging unit within the rotatable range of the lever member and when the contact supporting portions are located at the predetermined positions.

2. The roll medium supporting apparatus according to claim 1, wherein the urging unit is configured to urge the lever member toward the position of the lever member assumed when the plurality of contact supporting portions are contracted in the radial direction.

3. The roll medium supporting apparatus according to claim 1, wherein the contact supporting portions are configured to rotate integrally with the base body portion by a power of a motor.

4. A printing apparatus comprising:

a feeding unit configured to feed printed medium;

a printing unit configured to execute a printing job by a printhead on the printed medium fed from the feeding unit; wherein the feeding unit includes the roll medium supporting apparatus according to claim 1.

* * * * *